US008104198B2

(12) United States Patent
Barras

(10) Patent No.: US 8,104,198 B2
(45) Date of Patent: Jan. 31, 2012

(54) ATTACHMENT ASSEMBLY FOR DECORATIVE SHOE ACCESSORY

(75) Inventor: Pamela Ohlsson Barras, New Orleans, LA (US)

(73) Assignee: Streetzie's High Heel Bunny Slippers, LLC, New Orleans, LA (US)

( * ) Notice: Subject to any disclaimer, the term of this patent is extended or adjusted under 35 U.S.C. 154(b) by 419 days.

(21) Appl. No.: 12/321,325

(22) Filed: Jan. 20, 2009

(65) Prior Publication Data

US 2010/0180472 A1 Jul. 22, 2010

(51) Int. Cl.
*A43B 23/00* (2006.01)
*A43B 23/24* (2006.01)

(52) U.S. Cl. ..... 36/136; 24/668; D2/976; 40/636

(58) Field of Classification Search ..... 36/132, 36/136; 24/668, 114.9, 114, 11, 41.1; D2/976; 2/245

See application file for complete search history.

(56) References Cited

U.S. PATENT DOCUMENTS

| | | | | | |
|---|---|---|---|---|---|
| 916,339 | A * | 3/1909 | Lemerand | 132/275 |
| 1,831,804 | A * | 11/1931 | Domkee | 24/668 |
| 2,598,218 | A * | 5/1952 | Brumby | 36/112 |
| 2,874,690 | A * | 2/1959 | Cowgill | 602/28 |
| 3,738,024 | A * | 6/1973 | Matsuda | 36/136 |
| 3,812,603 | A * | 5/1974 | Goodman | 36/136 |
| 4,026,047 | A * | 5/1977 | Ahmer | 36/136 |
| 5,035,070 | A | 7/1991 | Gray, Jr. | |
| 5,496,612 | A * | 3/1996 | Ransbottom | 428/99 |
| 7,210,251 | B1 | 5/2007 | Rolle | |
| 7,581,338 | B1 * | 9/2009 | Housley et al. | 36/131 |
| 2006/0174522 | A1 * | 8/2006 | Yu | 36/141 |
| 2006/0207127 | A1 | 9/2006 | McGrath | |
| 2007/0186455 | A1 | 8/2007 | Lin | |
| 2009/0300948 | A1 * | 12/2009 | Nordstrom-Wehner | 36/136 |

* cited by examiner

*Primary Examiner* — Jila Mohandesi

(74) *Attorney, Agent, or Firm* — Keaty Law Firm, LLC

(57) ABSTRACT

Attaching a three-dimensional ornamental article to a shoe upper is achieved using a stiff elongated strip that is bent to form an arcuate upper portion and a J-shaped lower portion. The upper portion is fitted to follow the contours of the top and sides of the ornamental article, while the lower portions are inserted through spaced openings formed in the shoe upper. The bottom ends of the lower portions face each other when they are positioned between the insole and outsole of the shoe. Once the outsole is secured with the insole, the ornamental article becomes securely attached to the shoe.

3 Claims, 3 Drawing Sheets

ATTACHMENT ASSEMBLY FOR DECORATIVE SHOE ACCESSORY

BACKGROUND OF THE INVENTION

The present invention relates to the general art of wearing apparel and to the particular field of shoes and accessories therefor.

While the main purpose of footwear is to protect and support the foot of a wearer, footwear is now used for displaying decorative elements, advertising of the manufacturer, personalized elements and the like. In recent years, it has become increasingly popular to wear special decorations on shoes. These decorations can be ornamental or can enhance the appearance of clothing worn with the shoes. The decorations can be made of leather, metal, fabric, or plastic.

Women's shoes are the type of footwear that can be enhanced by the addition of decorative elements. While small decorative elements, such as buttons, buckles and the like are widely available, there exists a need to provide a method of ornamenting the appearance of a shoe with bold, three-dimensional objects that can appeal to a wide variety of potential users.

The present invention contemplates provision of a method of personalizing and adorning footwear by attaching decorative three-dimensional objects to footwear.

SUMMARY OF THE INVENTION

It is, therefore, an object of the present invention to provide an attachment assembly for securing a three-dimensional object to a shoe.

It is another object of the invention to provide an article of footwear having a decorative element secured to the shoe upper portion.

It is a further object of the invention to provide a method of decorating a shoe upper with a three-dimensional object.

These and other objects of the invention are achieved through a provision of an at attachment assembly that can be formed as a stiff elongated strip to form two mirror-image halves or from two stiff non-collapsible strips that are mirror-images of each other. Each strip (or each half) is bent to form an arcuate upper portion and a J-shaped lower portion. The upper portion is fitted to follow the contours of the top and sides of the ornamental article, while the lower portions are inserted through openings formed in the shoe upper. The bottom ends of the lower portions face each other when they are positioned between the insole and outsole of the shoe. Once the outsole is secured with the insole, the ornamental article becomes securely attached to the shoe.

In one aspect, the ornamental article is a stylized animal head, such as a bunny head. An additional securing member provides support for the ears of the animal head extending upwardly and outwardly to the upper portions.

BRIEF DESCRIPTION OF THE DRAWINGS

Reference will now be made to the drawings, wherein like parts are designated by like numerals, and wherein.

DETAIL DESCRIPTION OF THE INVENTION

According to the present disclosure an attachment assembly for footwear adornment is provided which is adapted to be affixed to footwear and may attach various useful and ornamental items. In its broad form, this assembly has a mount that may be used for attachment of an ornamental article to various types and items of footwear and is adapted to support or display one or more useful or ornamental articles.

Figure 1:
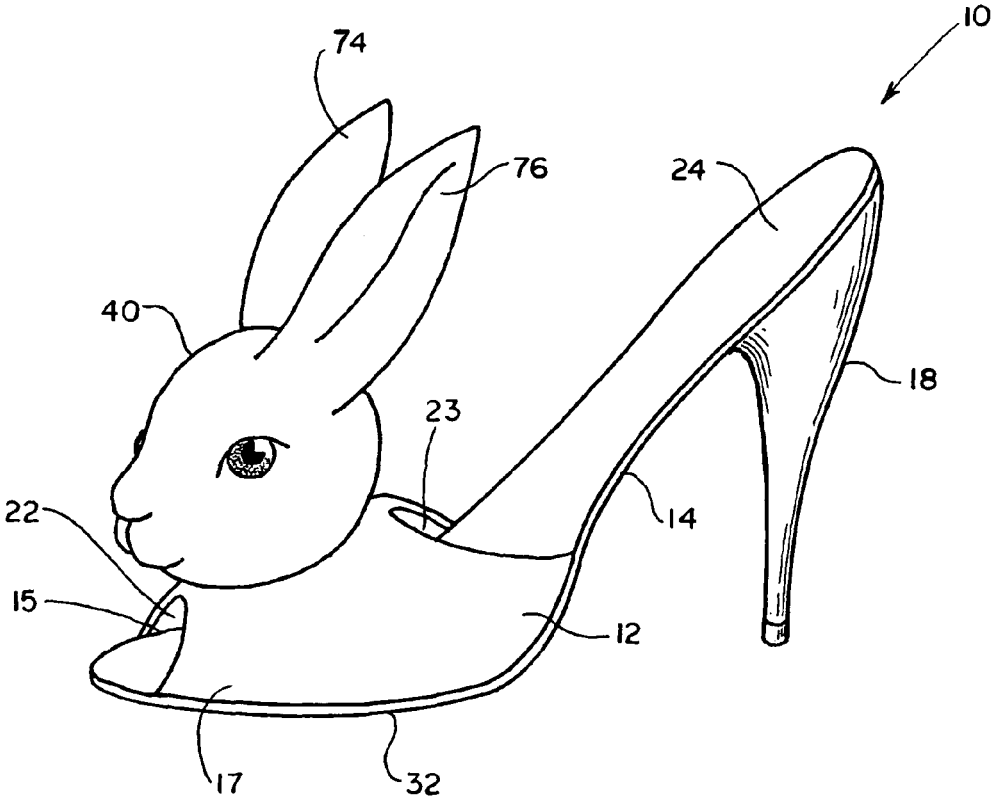
FIG. 1 is a perspective view of a shoe with a decorative accessory secured to the shoe upper.

Turning now to the drawings in more detail, an article of footwear is designated by numeral 10. The footwear 10 can be an open-toe shoe, as shown in FIG. 1, a high-heel shoe, a slipper or any other type of footwear. The shoe 10 generally includes an upper 12, an outsole 14, an insole 16, and a heel 18.

The upper 12 generally forms the body of the shoe 10. The upper 12 includes an outer surface 20 and an inner surface 22. A foot opening 23 allows a user to insert her foot into a foot-receiving pocket defined by the upper 12 and the insole 16. If desired, the shoe 10 may be made with an open-toe upper, with an opening 15 defined by a cut-out toe portion 17 of the upper 12. The upper may be constructed of any conventional material, such as leather, fabric and the like.

The insole 16 includes a top surface 24 and bottom surface 26. The outsole 14 includes a top surface 30 and a bottom surface 32. The bottom surface 32 of the outsole 14 along with the heel 18 provides the ground-contacting surface of the shoe 10. The contours of the insole 16 generally match the contours of the outsole 14. The outsole 14 may be constructed in any manner or of any material that is known in the art. For example, the outsole may be constructed of rubber, leather or polyurethane.

The attachment assembly 50 of the present invention is designed to secure an ornamental three-dimensional object 40 to the shoe 10. In the embodiment illustrated in the drawings, the ornamental object 40 is a stylized bunny head. It will be apparent to persons skilled in the art that other ornamental objects can be secured using the attachment assembly of this invention.

According to the instant invention the attachment assembly 50 comprises either a unitary stiff non-collapsible elongated body having two mirror image halves or made of a pair of stiff, somewhat bendable non-collapsible strips 52, 54 that support and secure the ornamental object 40 to the shoe upper 12. The strips 52, 54 are mirror images of each other; they can be made of rigid plastic, lightweight metal and other suitable material. Alternatively the attachment assembly 50 can be formed from a single strip configured to extend into the supported ornament 40 and to be secured to the shoe 10 from the same material as the individual strips 52, 54.

Each strip 52, 54 comprises a generally J-shaped lower portion 56, 58, respectively, and an arcuate upper portion 62, 64, respectively. In the upper portions, the strips 52, 54 converge to form a loop for supporting the ornamental object 40. The strip 52 is bent outwardly, as at 53, at the intersection of the J-shaped portion 56 and the arcuate portion 62. The strip 54 is similarly outwardly bent, as at 57 at the intersection of the J-shaped portion 58 and the arcuate portion 64.

The curvature of the arcuate portions 62, 64 depends on the type of object the attachment assembly 50 supports. In this case, the radius of curvature can follow the rounded lines of the bunny head 40. In this embodiment, the upper arcuate portions 62, 64 are configured to form a loop that extends about the topmost part and sides of the ornamental object, the bunny head 40. Of course, should the supported object 40 be of another configuration the upper portions of the strips 52, 54 can be formed differently.

The strips 52, 54 are bent at 53 and 57 before entering the body of the ornamental object 40, with the bottom of the object 40 resting on the tops of the J-shaped portions 56, 58.

The strips 52, 54 should preferably have the hook-shaped lower portions to allow securing of the strips 52, 54 to the shoe 10.

A pair of spaced openings 42, 46 is formed in the upper 12. The strips 52, 54 are inserted through the openings 42, 46 extending into the shoe upper, as shown by phantom lines in FIGS. 2 and 3. In this manner the attachment assembly is concealed from view and does not obscure the outer appearance of the shoe 10. The J-shaped portions 56, 58 follow the general configuration of the shoe upper so as not to cause any discomfort to the user. The J-shaped portions are protected by a lining (non-shown) that covers the inner surface 22 of the shoe upper 12.

The bottom parts 66, 68 of the J-shaped portions 56, 58 are oriented inwardly toward each other and toward the center of the shoe upper 12. The strips 52, 54 are dimensioned to allow the bottom parts 66, 68 to be positioned between the bottom surface 26 of the insole 16 and the top surface 30 of the outsole 14.

An optional support member 70 is secured to the loop formed by the curved portions 62, 64. The support member 70 can be attached by a mechanical means, such as rivet 72, button and the like. The same mechanical attachment can be used for securing the ends of the strips 52, 54 if the strips 52, 54 are formed as separate units.

Figure 2:
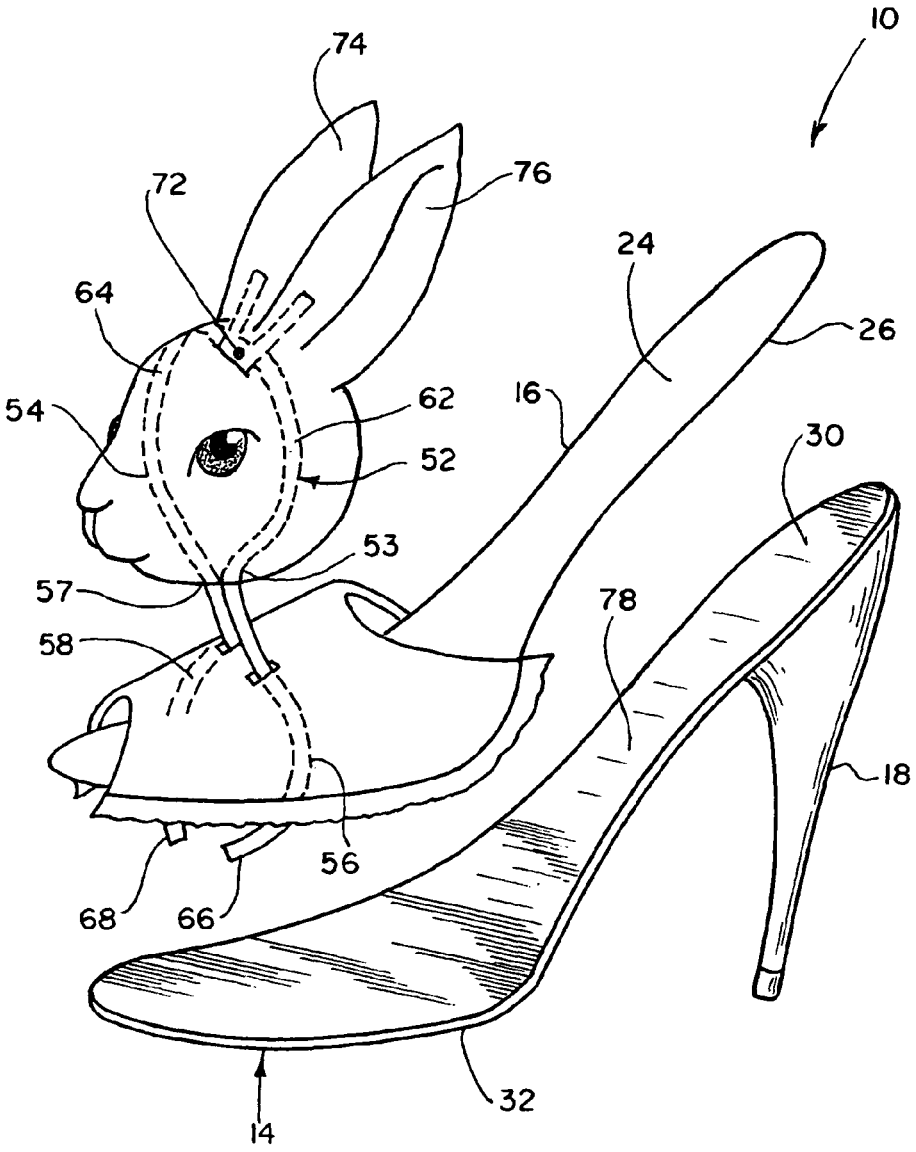
FIG. 2 is an exploded view illustrating the securing assembly for the decorative accessory.
Figure 3:
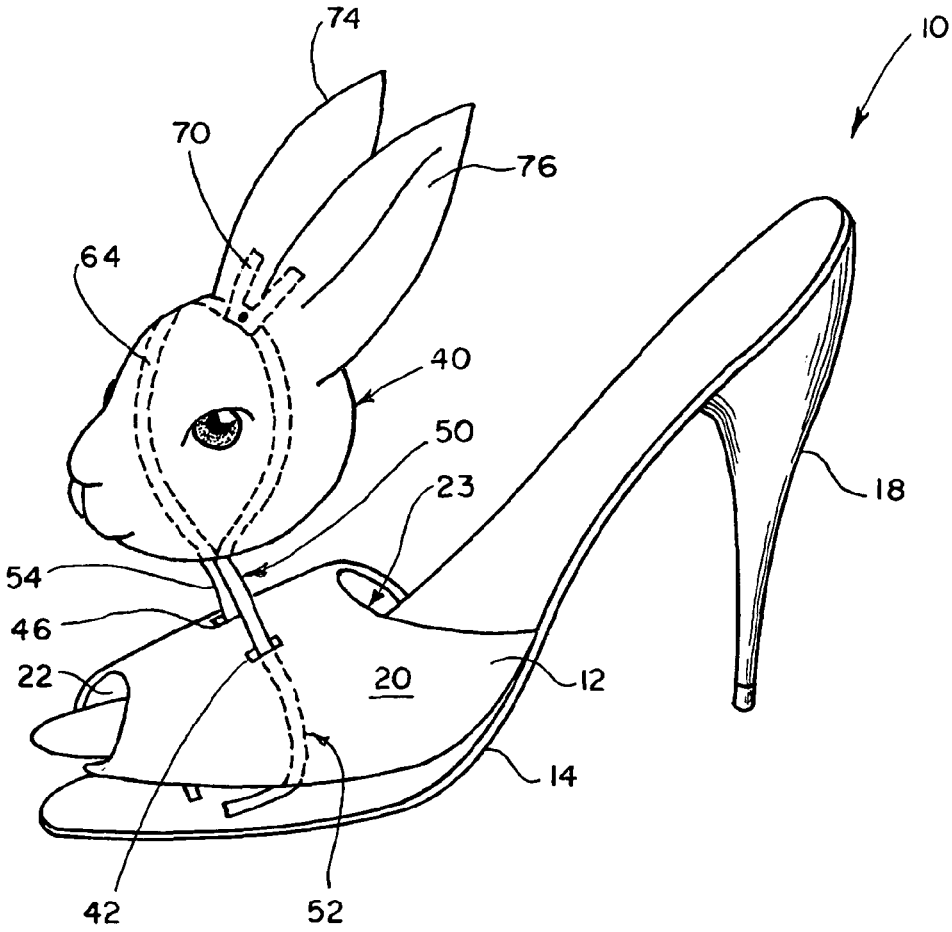
FIG. 3 is an exploded view illustrating a manner of securing the decorative accessory to the shoe.

The support member illustrated in FIGS. 2 and 3 has a generally V-shaped configuration extending outwardly and upwardly from the curved arcuate portions 62, 64. The two branches of the V-shaped support member provide a degree of rigidity to the ears 74, 76 of the bunny head 40. The support member 70 allows the ears 74, 76 to be retained in a relatively upright orientation in relation to the head 40.

The method of securing the ornamental object 40 to the shoe 10 provides for the attachment assembly 50 to be secured to the ornamental object 40 by inserting the strips 52, 54 into the body of the object 40 and concealing the strips by using a conventional covering material, such as leather, fabric and the like. The arcuate portions 62, 64 are bent toward each other to form the loop extending within the body of the ornamental object 40. An optional support member 70 is secured to extend into the ears of the article 40 if that article is formed as an animal head.

The lower portions of the strips 52, 54 are allowed to extend downwardly from the ornamental object 40. The J-shaped portions of the strips 52, 54 are then forced through the openings 42, 46 formed in the upper 12 and extended to a position under the insole 16. A layer of adhesive 78 is deposited on the top surface 30 of the outsole 14. The insole 12 is then pressed against the adhesive layer 78, securing the ends 66, 68 of the strips 52, 54 between the insole 12 and the outsole 14. Once the adhesive hardens, the decorative object 40 becomes permanently secured to the shoe 10. Alternatively, the attachment of the insole to the outsole may be made with mechanical means, such as by stitching and the like.

In manufacturing, as manufacturing the bunny head shoe, the present invention allows the manufacturer to save labor costs. Only one mold of the shoe body is necessary. The mold of shoe body can be decorated with various detachable ornaments, doll heads, animal heads and other three-dimensional objects. Thus the manufacturing processes and costs are reduced greatly.

Many changes and modifications can be made in the design of the present invention without departing from the spirit thereof I therefore pray that my rights to the present invention be limited only by the scope of the appended claims.

I claim:

1. A method of attaching an ornamental object to a shoe having a shoe upper, an insole and an outsole, the method comprising the steps:

providing a pair of stiff non-collapsible strips, each strip having an upper portion and a J-shaped lower portion unitary connected to the upper portion;

securing the ornamental object to the upper portions;

providing a pair of spaced-apart openings in the shoe upper, each of said openings being sized to receive the lower portion therethrough;

inserting the lower portion through a corresponding opening in the shoe upper, while extending bottom ends of the lower portion under the shoe upper such that the bottom ends of each lower portion face each other while being positioned between the outsole and the insole;

securing the insole to the outsole, thereby securing the ornamental object to the shoe upper.

2. The method of claim 1, further comprising the step of providing a support member and attaching the securing member between the upper portions such that the securing member extends outwardly and upwardly from the elongated strips.

3. The method of claim 2, wherein said support member has a generally V-shaped configuration.

* * * * *